US006588192B1

(12) United States Patent
Rice

(10) Patent No.: US 6,588,192 B1
(45) Date of Patent: Jul. 8, 2003

(54) METHODS OF MAKING NEW CHENILLE YARNS FOR HIGH SPEED WEAVING APPLICATIONS AND IMPROVED PRODUCT WEAR PERFORMANCE

(75) Inventor: J. Derrill Rice, Elkin, NC (US)

(73) Assignee: Chatham, Inc., Atlanta, GA (US)

( * ) Notice: Subject to any disclaimer, the term of this patent is extended or adjusted under 35 U.S.C. 154(b) by 0 days.

(21) Appl. No.: 09/333,602

(22) Filed: Jun. 15, 1999

Related U.S. Application Data

(63) Continuation-in-part of application No. 09/075,595, filed on May 11, 1998, now Pat. No. 6,107,218.

(51) Int. Cl.[7] ..... D02G 3/42
(52) U.S. Cl. ..... 57/203; 57/24
(58) Field of Search ..... 28/144, 220; 57/24, 57/256, 203; 428/372, 378; 442/59, 197

(56) References Cited

U.S. PATENT DOCUMENTS

| | | | | |
|---|---|---|---|---|
| 2,575,753 A | | 11/1951 | Foster | |
| 2,956,328 A | | 10/1960 | Faw | |
| 3,715,878 A | | 2/1973 | Kim | |
| 3,854,177 A | | 12/1974 | Breen et al. | |
| 3,869,850 A | | 3/1975 | Gross | |
| 3,969,881 A | | 7/1976 | Boldrini | |
| 4,114,549 A | | 9/1978 | Chambley et al. | |
| 4,192,355 A | | 3/1980 | Peeler et al. | |
| 4,250,701 A | | 2/1981 | Schwartz et al. | |
| 4,490,995 A | | 1/1985 | Schmidt | |
| 4,517,715 A | * | 5/1985 | Yoshida et al. | 139/393 |
| 4,528,809 A | | 7/1985 | Schwartz et al. | |
| 4,668,552 A | | 5/1987 | Scott | |
| 5,009,946 A | | 4/1991 | Hatomoto et al. | |
| 5,178,630 A | * | 1/1993 | Schmitt | 623/1 |
| 5,259,178 A | | 11/1993 | Sostegni | |
| 5,417,048 A | * | 5/1995 | Thomas | 57/256 |
| 5,547,732 A | | 8/1996 | Edwards et al. | |
| 5,590,692 A | | 1/1997 | Dornier et al. | |
| 5,651,168 A | * | 7/1997 | Tung et al. | 28/144 |
| 5,763,080 A | * | 6/1998 | Stahl et al. | 428/378 |

FOREIGN PATENT DOCUMENTS

JP 4-333633 11/1992

OTHER PUBLICATIONS

Muller, Friedrich "Projectile Loom for Chenille Yarns," *Melliand Textilberichte* [English Edition], pp. 721–725, (Sep., 1977).

Wahoud, A., et al. "Dornier Loom for a Wide Range of Applications," Textile Technology, pp. 26–28, (Feb., 1994).

"Dornier Air Jet Terry Loom with New Performance Features," *Textil Praxis International* (Foreign Edition), 48, No. 6, XXIV, (Jun., 1993).

"Picanol airjet weaving machines," Picanol N.V. Weefautomaten, Polenlaan 3–7, B–8900 leper.

* cited by examiner

*Primary Examiner*—John J. Calvert
*Assistant Examiner*—Shaun R Hurley
(74) *Attorney, Agent, or Firm*—Merchant & Gould, LLC

(57) ABSTRACT

The present invention is directed to new chenille yarns and methods of making the same. The present invention is further directed to new chenille yarns having a spun core containing low-melting staple-length binder fibers and methods of making the same. The chenille yarns may be used on conventional weaving equipment, including air jet and water jet weaving machines, to produce simulated pile fabrics having superior abrasion resistance and improved hand. The present invention is, also directed to methods of making fabrics containing the chenille yarn, and various uses for the fabrics, especially as residential upholstery fabrics, decorative throws, contract fabrics, automotive fabrics, and bedding fabrics for use in the home.

26 Claims, 3 Drawing Sheets

METHODS OF MAKING NEW CHENILLE YARNS FOR HIGH SPEED WEAVING APPLICATIONS AND IMPROVED PRODUCT WEAR PERFORMANCE

RELATED APPLICATIONS

The present patent application is a continuation-in-part of U.S. patent application Ser. No. 09/075,595, filed on May 11, 1998 now U.S. Pat. No. 6,107,218.

FIELD OF THE INVENTION

The present invention is directed to a new chenille yarn and a method of making the same. The chenille yarn may be used on conventional weaving equipment, including air jet and water jet weaving machines, to produce fabrics having superior abrasion resistance and improved hand. The present invention is also directed to a method of making fabrics containing the chenille yarn, and various uses for the fabrics, especially as residential upholstery fabrics, decorative throws, contract fabrics, automotive fabrics, and bedding fabrics for use in the home.

BACKGROUND OF THE INVENTION

Conventional chenille yarns are used in a variety of fabrics to produce a simulated pile on a surface of the fabric. Attempts have been made to improve the abrasion resistance and to decrease the amount of pile loss associated with chenille yarns. Early attempts to improve the abrasion resistance of chenille yarns, such as disclosed in U.S. Pat. No. 3,969,881, utilized mechanical means, such as twisting of one or more core yarns, to lock pile or effect yarns in place; however, the resulting chenille yarns had less than acceptable abrasion resistance. More recently, adhesive means have been utilized to secure pile or effect yarns to the chenille yarn core. U.S. Pat. Nos. 5,009,946 and 5,651,168 disclose chenille yarns comprising one or more multifilament, continuous, low-melting binder yarns in the core of the chenille yarn, which adhesively secure pile or effect yarns to the core. By incorporating one or more multifilament, continuous, low-melting binder yarns in the core of the chenille yarn, and subsequently melting the binder yarn, a chenille yarn having better abrasion resistance and decreased pile loss is produced.

Although significant improvements have been made with chenille yarns, conventional chenille yarns, such as those disclosed in the above-referenced patents, still have several shortcomings. Most conventional chenille yarns can only be used on relatively low speed weaving machines, such as shuttle or Rapier looms. Attempts have been made to use conventional chenille yarns on high speed weaving machines, such as air jet and water jet weaving equipment; however, as the chenille yarn is unwound from cones, the chenille yarn has a tendency to curl, which results in weave inefficiencies such that air jet and water jet weaving is virtually impossible. It is believed that the tendency of conventional chenille yarns to curl results from a curved orientation memory in the yarn due to storage and/or heat treatment of the yarn while wound on a cone. For example, if the chenille yarn is on a cone and subjected to a heat treatment to melt a binder core yarn, the chenille yarn wants to retain the curved orientation that it has on the cone. Also, conventional chenille yarn experiences significant tuft or pile loss during the weaving process because the effect yarn is not adequately secured to the yarn core.

Other conventional chenille fabrics require post-weaving finishing processes in order to secure the pile or effect yarn to the chenille core and/or prepare the fabric for consumer use. For example, the chenille fabrics disclosed in U.S. Pat. No. 5,651,168 are prepared from chenille yarns which must be heatset after weaving in order to melt a binder fiber in the core of the chenille yarns. Even with one or more finishing processes, conventional chenille fabrics must be hand washed to prevent pile loss during washing or dry cleaning. A commercially available machine washable or dry cleanable chenille fabric coming directly off of a weaving machine does not exist, especially in the area of bedding products such as blankets and quilts.

There exists a need in the art for a chenille yarn, which provides exceptional abrasion resistance and decreased pile loss, and may be used on all types of weaving equipment, including water and air jet weaving machines. There also exists a need in the art for chenille fabrics, which are ready for consumer use and machine washable and dry cleanable, without the need for post-weaving finishing processes as in conventional chenille fabrics.

SUMMARY OF THE INVENTION

The present invention is directed to novel chenille yarns having superior abrasion resistance and decreased pile loss. The chenille yarns may be used on shuttle looms, as well as, high speed weaving machines, such as water and air jet looms. The chenille yarns may be used to make chenille fabrics for a variety of fabric applications. In one embodiment of the present invention, the chenille yarn is woven into fabrics for use as bedding products, such as blankets, decorative throws, quilts and blankets. The bedding products are machine washable or dry cleanable.

The present invention is also directed to methods of making novel chenille yarns and fabrics containing the same. In one embodiment of the present invention, the method comprises forming a core component of the chenille yarn by intimately blending a high-melting staple fiber and a low-melting staple binder fiber to form the core component. In a second embodiment of the present invention, a method comprises a heating and cooling step prior to weaving, wherein a low-melting core component of the chenille yarn melts to secure the pile or effect yarn to the chenille core. In a further embodiment of the present invention, the method comprises weaving a chenille fabric on a water or air jet loom using the chenille yarn of the present invention.

The chenille yarns of the present invention satisfy the need for a multi-purpose chenille yarn, capable of being used on any type of weaving equipment. The chenille fabrics of the present invention satisfy the need for a machine washable or dry cleanable fabric having exceptional fabric softness and feel. A detailed description of the chenille yarns and fabrics of the present invention and their various applications is provided below.

DETAILED DESCRIPTION OF THE INVENTION

Figure 1:
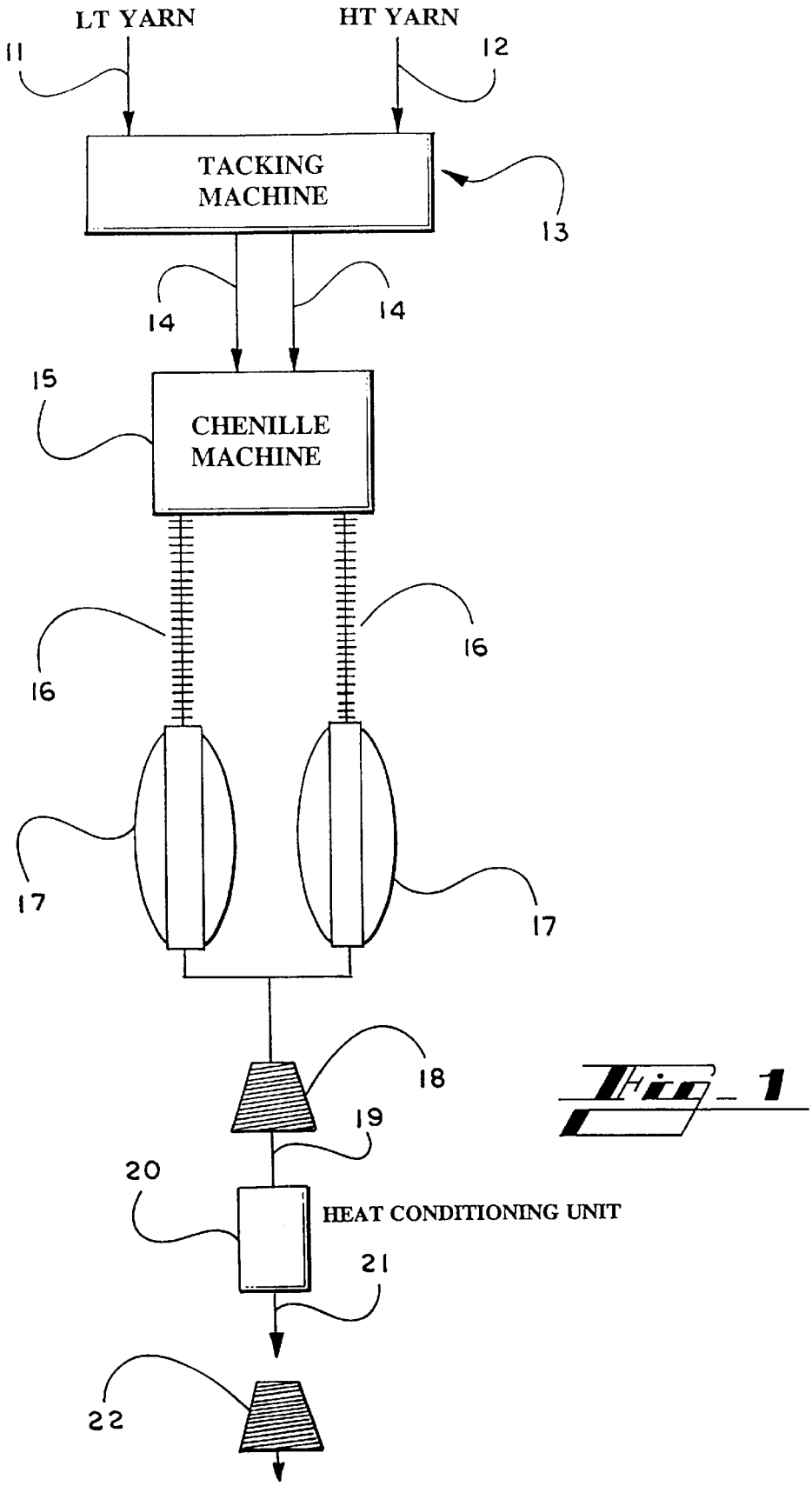
FIG. 1 is a schematic representation of the process steps for forming a chenille yarn of the present invention.

The present invention is directed to new chenille yarns and methods of making the same. The chenille yarns may be used on conventional weaving equipment, such as Rapier and shuttle looms. In addition, the chenille yarns of the present invention are capable of being used on high speed weaving machines, such as air jet and water jet weaving machines. The resulting woven pile fabrics, formed from the chenille yarns of the present invention, have superior abrasion resistance and improved hand at reduced cost. The present invention is also directed to methods of making fabrics containing the chenille yarn, and various uses for the fabrics, especially as residential upholstery fabrics, decorative throws, contract fabrics, automotive fabrics, and bedding fabrics for use in the home.

As used herein, the term "chenille yarn" refers to a yarn having a core component and a pile or effect component. The core component may comprise one or more staple-length fibers, continuous filaments or yarns mechanically interengaged with one another. One or more of the mechanically interengaged core components may be a low-melting staple-length fiber, continuous filament or yarn, which melts to securely fix the pile or effect component to the core component. The pile or effect component of the chenille yarn extends outwardly from the core a distance equal to or less than the pile length, depending on the angle between the core component and the pile components.

As used herein, the term "chenille fabric" refers to a fabric containing at least some chenille yarns. The chenille yarns alone may form the chenille fabric or may be combined with other yarns to form the chenille fabric.

As used herein, the term "woven fabric" refers to a fabric containing a structure of fibers, filaments or yarns, which are orderly arranged in an interengaged fashion. Woven fabrics typically contain interengaged yarns in a "warp" and "fill" direction. The warp direction corresponds to the length of the fabric while the fill direction corresponds to the width of the fabric. Woven fabrics can be made on a variety of looms including, but not limited to, shuttle looms, Rapier looms, projectile looms, air jet looms and water jet looms.

CMI's High Performance Chenille Yarns

The present invention is directed to high performance chenille yarns. The high performance chenille yarns of the present invention satisfy the need for chenille yarns having superior abrasion resistance as well as processability on a variety of weaving machines. The chenille yarns of the present invention comprise at least one low-melting core component and a pile or effect yarn. In one embodiment of the present invention, the chenille yarn comprises at least one low-melting core component in combination with at least one high-melting core component. In a further embodiment of the present invention, the chenille yarn comprises one or more pile or effect yarns, which extend radially from the chenille core. By combining various core yarns and pile yarns having specific dyeability, a variety of single and multi-color chenille yarns may be produced.

Suitable pile or effect yarns for use in the chenille yarns of the present invention include, but are not limited to, natural fibers, such as cotton, linen, jute, hemp, cotton, wool, and wood pulp; regenerated cellulosic fibers such as viscose rayon and cuprammonium rayon; modified cellulosic fibers, such as cellulose acetate; and synthetic fibers such as those derived from polypropylene, polyethylene, polyvinyl alcohol, polyesters, polyamides, and polyacrylics. The above-mentioned pile or effect yarns may be used alone or in combination with one another. Multicomponent fibers comprising a blend of one or more of the above materials may also be used if so desired. Desirably, the pile or effect yarn comprises cotton, wool or acrylic yarns, alone or in combination with one another.

By "low-melting core component" it is meant a staple-length fiber, or a continuous filament or multifilament yarn having a low melting point relative to a "high-melting core component" of the chenille yarn or the pile or effect yarn of the chenille yarn. Typically, low-melting core components are in the form of binder fibers having a melting or softening point of less than about 110° C. Suitable low-melting binder yarns include, but are not limited to, polypropylene, polyethylene, ethylene-propylene copolymers, nylon, polyester and combinations thereof. The above-mentioned low-melting binder yarns may be used alone or in combination with one another. Multicomponent binder fibers comprising a blend of one or more of the above materials may also be used if so desired. Desirably, the low-melting binder yarn comprises polyethylene and ethylene-propylene copolymers.

In one embodiment of the present invention, the low-melting core component comprises one or more types of low-melting staple-length binder fibers intimately blended with one or more high-melting staple-length fibers, having a melting point higher than the low-melting staple-length fibers. The low-melting staple-length binder fibers typically have a melting or softening point of less than about 110° C. Further, the low-melting staple-length binder fibers typically have a fiber length of less than about 5 inches and a fiber denier of less than about 10 denier. Desirably, the low-melting staple-length binder fibers have a fiber length of from about 0.25 inches to about 2 inches and a fiber denier of less than about 5 denier. More desirably, the low-melting staple-length binder fibers have a fiber length of from about 1 inch to about 2 inches and a fiber denier of from about 2 denier to about 5 denier.

Suitable low-melting staple-length binder fibers include, but are not limited to, polypropylene, polyethylene, ethylene-propylene copolymers, nylon, polyester and combinations thereof. The above-mentioned low-melting staple-length fibers may be used alone or in combination with one another. Multicomponent low-melting staple-length binder fibers, such as sheath-core or side-by-side fibers, comprising a blend of one or more of the above materials may also be used if so desired. Desirably, the low-melting staple-length binder fiber comprises polyethylene and ethylene-propylene copolymers.

By "high-melting core component," it is meant a staple-length fiber or a continuous filament or multifilament yarn having a melting point higher than the low-melting binder fiber or yarn of the chenille yarn. Typically, high-melting core components have a melting or softening point of about 10° C. greater than the melting or softening point of the low-melting binder fiber or yarn. Desirably, the high-melting core components have a melting or softening point of about 20° C. greater than the melting or softening point of the low-melting binder fiber or yarn. Typically, high-melting core components are in the form of fibers or yarns having a melting or softening point of more than about 130° C. Further, high-melting fibers typically have a fiber length of less than about 5 inches and a fiber denier of less than about 10 denier. Desirably, the high-melting staple-length binder fibers have a fiber length of from about 0.25 inches to about 2 inches and a fiber denier of less than about 5 denier. More desirably, the high-melting staple-length binder fibers have a fiber length of from about 1 inch to about 2 inches and a fiber denier of from about 1 denier to about 3 denier.

Suitable high-melting fibers or yarns include, but are not limited to, natural fibers, such as cotton, linen, jute, hemp, cotton, wool, and wood pulp; regenerated cellulosic fibers such as viscose rayon and cuprammonium rayon; modified cellulosic fibers, such as cellulose acetate; and synthetic fibers such as those derived from polypropylene, polyvinyl alcohol, polyesters, polyamides, acrylics and polyacrylics. The above-mentioned high-melting core yarns may be used alone or in combination with one another. Multicomponent high-melting core yarns comprising a blend of one or more of the above materials may also be used if so desired. Desirably, the high-melting core yarn comprises polyester, nylon and acrylics.

The chenille yarns of the present invention may be prepared according to the methods described below. In one embodiment of the present invention, a chenille yarn is produced by a process wherein at least one low-melting binder yarn is fed along with at least one high-melting core yarn into a chenille machine. Desirably, the high-melting core yarn has a softening or melting point of at least 10° C. higher than the low-melting binder yarn. A number of chenille machines are well known to those of ordinary skill in the art and may be used to prepare the chenille yarn of the present invention. Suitable chenille machines include, but are not limited to, those disclosed in U.S. Pat. No. 3,869,850 issued to Gross; U.S. Pat. No. 3,969,881 issued to Boldrini; and U.S. Pat. No. 5,259,178 issued to Sostegni. The resulting chenille yarn is subsequently fed under tension through a heat conditioning unit to melt the low-melting binder yarn. The chenille yarn exits the heat conditioning unit with the pile or effect yarn securely attached to the core of the chenille yarn. Then, the chenille yarn is wound onto one or more cones for storage prior to weaving. Alternatively, the chenille yarn is fed directly to a weaving machine for incorporation into a woven fabric.

One method of producing the chenille yarns of the present invention is schematically described in FIG. 1. Referring to FIG. 1, at least one low-melting binder yarn 11 is fed along with at least one high-melting core yarn 12 to an optional tacking machine 13. Desirably, the high-melting core yarn 12 has a softening or melting point of at least 10° C. higher than the low-melting binder yarn 11. Tacking machine 13 mechanically attaches the low-melting yarn 11 with the high-melting yarn 12 by one or more methods including, but not limited to, air texturizing, taslan, air entanglement, hollow spindle twisting and novelty twisting. One or more core yarns 14 exit the tacking machine and feed into a chenille machine 15. It should be noted that the low-melting binder yarn 11 and the high-melting core yarn 12 may be fed directly to a chenille machine without processing through a tacking machine. As the chenille yarns 16 exit chenille machine 15, chenille yarns 16 are taken up on bobbins 17 and subsequently transferred onto cones 18.

Chenille yarn 19 is unwound from cones 18 and fed under tension through heat conditioning unit 20 to melt the low-melting binder yarn 11. Upon cooling, chenille yarn 21 exits the heat conditioning unit with the pile or effect yarn securely attached to the core of the chenille yarn. Moreover, chenille yarn 21 has a "orientation memory" heatset into the yarn even though chenille yarn 21 is rewound onto cones 22. The "orientation memory" of chenille yarn 21 minimizes the curling associated with yarn when the yarn is unwound from a cone. Cones 22 are then transported to a weaving loom where the chenille yarn is woven into a chenille fabric.

Figure 2:
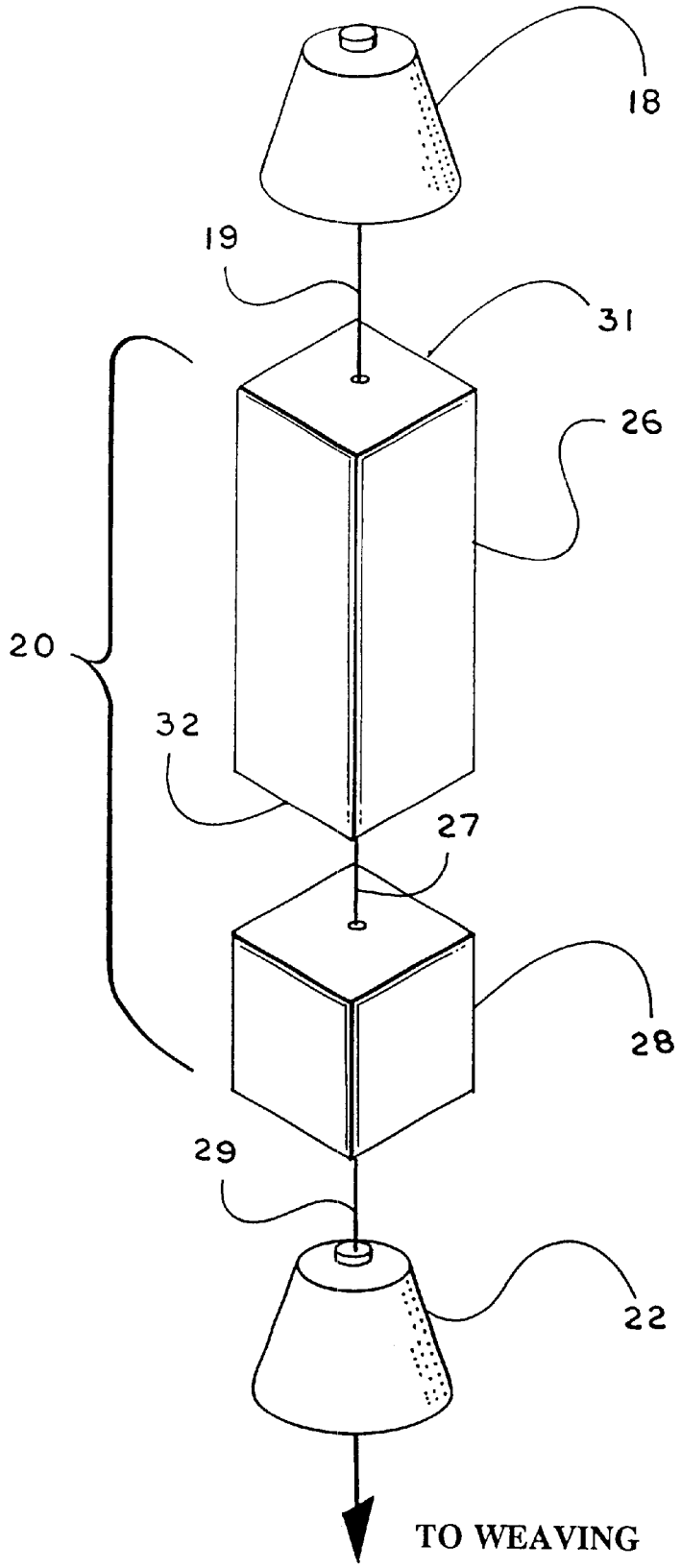
FIG. 2 is a schematic representation of the process steps for melting the low-melting binder yarn of the chenille yarn of the present invention.

FIG. 2. displays a schematic representation of the components of heat conditioning unit 20. Heat conditioning unit comprises a heating chamber 26 and a cooling chamber 28. Heating chamber 26 has dimensions (height and width) such that multiple chenille yarns 19 may enter heating chamber 26 at entrance 31. The length of heating chamber 26 may vary as long as chenille yarn 19 is subjected to a sufficient amount of heat to melt the low-melting binder yarn component as chenille yarn 19 passes from the entrance 31 to the exit 32 of the heating chamber 26. The heat source in heat chamber 26 may be any heat source known to those of ordinary skill in the art including, but not limited to, steam, electric lamps and gas burners. As chenille yarn 27 exits heating chamber 26, chenille yarn 27 is tacky due to the melted binder yarn. Cooling chamber 28 allows chenille yarn 27 to harden prior to being rewound onto cones 22. Cooling chamber 28 has dimensions (height and width) such that multiple chenille yarns 27 may enter cooling chamber 28. The length of cooling chamber 28 may vary as long as chenille yarn 27 is sufficiently cooled to harden the melted binder yarn component of chenille yarn 27. Desirably, the cooling chamber 28 comprises air at atmospheric conditions. Alternatively, chenille yarn 27 exits heating chamber 26 and travels a distance prior to winding (without cooling chamber 28), which allows for cooling of the chenille yarn. Chenille yarn 29 is then rewound onto cones 22 and transported to a weaving operation.

Although not fully understood, it is believed that as chenille yarn 29 cools, an orientation memory is set into chenille yarn 29. This orientation memory causes chenille yarn 29, under tension, to return to the orientation of the yarn as the yarn traveled through the heat conditioning unit 20 (a straight orientation) once the tension is removed. It is believed that this orientation memory unexpectedly results in a chenille yarn, which may be used efficiently on high speed weaving equipment, including air and water jet weaving machines.

In another embodiment of the present invention, a chenille yarn is produced by a process wherein at least one type of low-melting staple-length binder fiber is intimately blended with at least one type of high-melting staple-length fiber to form a spun core yarn. Desirably, the high-melting staple-length fiber has a softening or melting point of at least 10° C. higher than the low-melting staple-length binder fiber. The staple-length fibers may be blended with one another using any blending process known to those of ordinary skill in the art. Desirably, the staple-length fibers are blended with one another using a carding process. The proportion of low-melting staple-length binder fiber to high-melting staple-length fiber may vary depending on a number of factors including, but not limited to, processability, cost, and desired fabric properties. Desirably, the spun core yarns comprise from about 5 to about 95 wt % low-melting staple-length binder fiber and from about 95 to about 5 wt % high-melting staple-length binder fiber. More desirably, the spun core yarns comprise from about 10 to about 50 wt % low-melting staple-length binder fiber and from about 90 to about 50 wt % high-melting staple-length binder fiber. Even more desirably, the spun core yarns comprise from about 10 to about 30 wt % low-melting staple-length binder fiber and from about 90 to about 70 wt % high-melting staple-length binder fiber.

Once formed, two of the spun core yarns containing staple-length binder fibers are fed into a chenille machine as described above. The resulting chenille yarn may be subsequently fed under tension through a heat conditioning unit to melt the low-melting binder yarn. The chenille yarn exits the heat conditioning unit with the pile or effect yarn securely attached to the core of the chenille yarn. Then, the chenille yarn is wound onto one or more cones for storage prior to weaving. Alternatively, the resulting chenille yarn is wound directly onto one or more cones for storage prior to weaving.

In a further alternative method, the resulting chenille yarn may be fed directly to a weaving machine for incorporation into a woven fabric. In the later two alternative embodiments, the woven fabric may be fed through a tenter frame to melt the low-melting binder fiber component of the chenille yarn.

CMI's High Performance Chenille Fabrics

Figure 3:
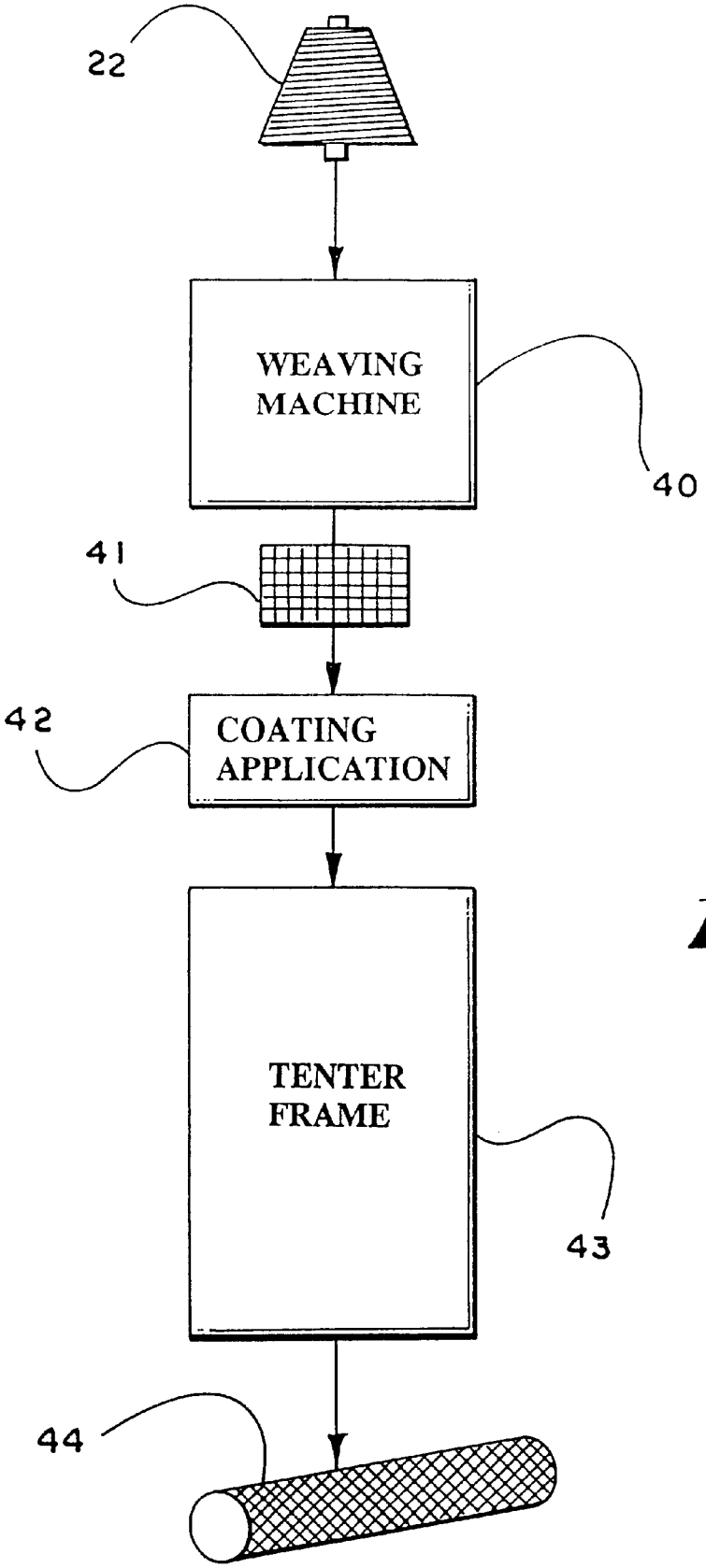
FIG. 3 is a schematic representation of the process steps for forming a chenille fabric of the present invention.

As shown in FIG. 3, cones 22 of chenille yarn may be fed to weaving machine 40 to produce a woven fabric 41. Suitable weaving machines 40 may include, but are not limited to, shuttle looms, Rapier looms, air jet weaving machines and water jet weaving machines. In one embodiment of the present invention, fabric 41 only requires washing and drying prior to consumer use. In other embodiments of the present invention, fabric 41 is subjected to additional finishing processes. Fabric 41 may be subjected to a coating application 42 and subsequently dried in a tenter frame 43 to produce a finished roll of chenille fabric 44. Suitable fabric finishes include, but are not limited to, latex coating, electreting, antistatic treatment, stain-proofing treatments, flame retardent treatment, anti-microbial surface treatments, dyeing and printing.

The chenille fabrics of the present invention find utility in industrial and institutional applications, as well as, the home. Potential applications include, but are not limited to, automotive fabrics, contract fabrics, residential fabrics and apparel fabrics. Potential applications in the home include, but are not limited to, decorative throws, upholstery fabrics, blankets and quilts. In one embodiment of the present invention, fabrics in the form of bedding products, such as blankets, decorative throws and quilts, are taken directly off of the loom, washed and dried, to be ready for consumer use. The fabrics are machine washable or dry cleanable, unlike conventional chenille fabrics.

The present invention is described above and further illustrated below by way of examples, which are not to be construed in any way as imposing limitations upon the scope of the invention. On the contrary, it is to be clearly understood that resort may be had to various other embodiments, modifications, and equivalents thereof which, after reading the description herein, may suggest themselves to those skilled in the art without departing from the spirit of the present invention and/or the scope of the appended claims.

EXAMPLE 1

A high performance chenille yarn was prepared by the following method. A high-melting core yarn of 20/1 spun polyester and a composite core yarn containing a low-melting component of 250 d polyethylene and a high-melting component of 20/1 spun polyester were parallel fed directly, into a chenille machine. A chenille yarn having a pile or effect yarn of acrylic was formed and wound onto cones. The chenille yarn was subsequently unwound from the cones and processed through a heat conditioning unit to melt the polyethylene component. The resulting yarn was rewound onto cones after cooling.

EXAMPLE 2

A high performance chenille yarn was prepared by the following method. Two composite core yarns containing a low-melting component of 250 d polyethylene, a high-melting component of 20/1 spun polyester and a high-melting -component of 70 d filament polyester were formed on a hollow spindle twister and fed into a chenille machine. A chenille yarn having a pile or effect yarn of acrylic was formed and wound onto cones. The chenille yarn was subsequently unwound from the cones and processed through a heat conditioning unit to melt the polyethylene component. The resulting yarn was rewound onto cones after cooling.

EXAMPLE 3

A high performance chenille yarn was prepared by the following method. A high-melting core yarn of 20/1 spun polyester was fed into a chenille machine along with a composite core yarn resulting from air texturizing a low-melting 250 d polyethylene yarn and a high-melting 200 d nylon yarn. A chenille yarn having a pile or effect yarn of acrylic was formed and wound onto cones. The chenille yarn was subsequently unwound from the cones and processed through a heat conditioning unit to melt the polyethylene component. The resulting yarn was rewound onto cones after cooling.

EXAMPLE 4

A high performance chenille yarn was prepared by the following method. A high-melting core yarn of 20/1 spun polyester and a composite core yarn containing a low-melting component of 250 d polyethylene and a high-melting component of 200 d nylon were parallel fed directly into a chenille machine. A chenille yarn having a pile or effect yarn of acrylic was formed and wound onto cones. The chenille yarn was subsequently unwound from the cones and processed through a heat conditioning unit to melt the polyethylene component. The resulting yarn was rewound onto cones after cooling.

EXAMPLE 5

A high performance chenille yarn was prepared by the following method. A high-melting core yarn of 20/1 spun polyester was fed into a chenille machine along with a composite core yarn resulting from conventional twisting of a low-melting 250 d polyethylene yarn and a high-melting 20/1 spun polyester yarn. A chenille yarn having a pile or effect yarn of acrylic was formed and wound onto cones. The chenille yarn was subsequently unwound from the cones and processed through a heat conditioning unit to melt the polyethylene component. The resulting yarn was rewound onto cones after cooling.

EXAMPLE 6

A high performance chenille yarn was prepared by the following method. Two ends of a high-melting core yarn of 20/1 spun polyester, which had been package dyed, and a low-melting component of 1/150/20 polyethylene were parallel fed directly into a chenille machine. A chenille yarn having an effect yarn of 395/92 d solution dyed nylon was formed and wound onto cones. The chenille yarn was subsequently unwound from the cones and processed through a heat conditioning unit to melt the polyethylene component. The resulting yarn was rewound onto cones after cooling.

COMPARATIVE EXAMPLE 7

A conventional chenille yarn was prepared by the following method. Two ends of a high-melting core yarn of 20/1 spun polyester, which had been package dyed, were parallel fed directly into a chenille machine. A chenille yarn having an effect yarn of 395/92 d solution dyed nylon was formed and wound onto cones.

EXAMPLE 8

The high performance chenille yarn of Example 6 and the conventional chenille yarn of Comparative Example 7 were woven into fabrics on identical Dornier weaving machines. The following performance criteria were measured.

| Operation | High Performance (Example 6) | Conventional (Example 7) |
|---|---|---|
| Weaving: | | |
| Yards/Break | 11.4 | 2.5 |
| Efficiency | 75% | 45% |
| Pile Loss @ Loom (in 100 yard sample) | 2.4 Grams | 10.2 Grams |
| Abrasion Testing Double Rubs | 45,000 Avg. | 14,000 Avg. |

EXAMPLE 9

A high performance chenille yarn was prepared by the following method. Two ends of a high-melting core yarn of 20/1 spun polyester, which had been package dyed, and a low-melting component of 1/150/20 polyethylene were parallel fed directly into a chenille machine. A chenille yarn having an effect yarn of 300/144 d solution dyed polypropylene was formed and wound onto cones. The chenille yarn was subsequently unwound from the cones and processed through a heat conditioning unit to melt the polyethylene component. The resulting yarn was rewound onto cones after cooling.

COMPARATIVE EXAMPLE 10

A conventional chenille yarn was prepared by the following method. Two ends of a high-melting core yarn of 20/1 spun polyester, which had been package dyed, were parallel fed directly into a chenille machine. A chenille yarn having an effect yarn of 300/144 d solution dyed nylon was formed and wound onto cones.

EXAMPLE 11

The high performance chenille yarn of Example 9 and the conventional chenille yarn of Comparative Example 10 were woven into fabrics on identical Dornier weaving machines. The following performance criteria were measured.

| Operation | High Performance (Example 9) | Conventional (Example 10) |
|---|---|---|
| Weaving: | | |
| Yards/Break | 12.9 | 2.6 |
| Efficiency | 79% | 40% |
| Pile Loss @ Loom (in 100 yard sample) | 2.8 Grams | 12.1 Grams |
| Abrasion Testing Double Rubs | 32,000 Avg. | 12,500 Avg. |

EXAMPLE 12

A high performance chenille yarn was prepared by the following method. Two ends of a high-melting core yarn of 14/1 cc spun acrylic, which had been package dyed, and a low-melting component of 1/150/20 d polyethylene were parallel fed directly into a chenille machine. A chenille yarn having an effect yarn of one end of 5/1 cc solution dyed acrylic was formed and wound onto cones. The chenille yarn was subsequently unwound from the cones and processed through a heat conditioning unit to melt the polyethylene component. The resulting yarn was rewound onto cones after cooling.

COMPARATIVE EXAMPLE 13

A conventional chenille yarn was prepared by the following method. Two ends of a high-melting core yarn of 14/1 cc spun acrylic, which had been package dyed, and a low-melting component of 1/150/20 d polyethylene were parallel fed directly into a chenille machine. A chenille yarn having an effect yarn of one end of 5/1 cc solution dyed acrylic was formed and wound onto cones. The chenille yarn was placed in an autoclave. The temperature of the autoclave was raised to melt the polyethylene component of the chenille yarn. The chenille yarn was subsequently removed from the autoclave and allowed to cool.

EXAMPLE 14

The high performance chenille yarn of Example 12 and the conventional chenille yarn of Comparative Example 13 were woven into fabrics on identical Dornier weaving machines. The following performance criteria were measured.

| Operation | High Performance Heatset Yarn (Example 12) | Conventional Autoclave Yarn (Example 13) |
|---|---|---|
| Weaving: | | |
| Yards/Break | 12.5 | 7.7 |
| Efficiency | 75% | 60% |
| Pile Loss @ Loom (in 100 yard sample) | 3.1 Grams | 3.0 Grams |
| Abrasion Testing Double Rubs | 30,000 Avg. | 28,600 Avg. |

EXAMPLE 15

A high performance chenille yarn was prepared by the following method. A blend of fibers was produced by carding 80 wt % acrylic staple-length fibers and 20 wt % low-melting staple-length polyethylene fibers in a WHITIN™ carding machine (60' width w/3 breakers). The acrylic staple-length fibers had a melting point of about 130° C.; a fiber length of about 2.0 inches, and a fiber denier of about 2 denier. The low-melting staple-length polyethylene fibers had a melting point of about 110° C. a fiber length of about 2.0 inches, and a fiber denier of about 5 denier. The fiber blend was spun into a 15/1 spun yarn using a spinning apparatus. Two of the 15/1 spun yarns were fed into a chenille machine along with an effect or pile yarn comprising 10/1 spun acrylic having a melting point of about 110° C. A chenille yarn was formed and wound onto cones.

Having thus described the invention, numerous changes and modifications thereof will be readily apparent to those having ordinary skill in the art, without departing from the spirit or scope of the invention.

What is claimed is:

1. A method of making a chenille yarn comprising the steps of:

feeding a plurality of yarns into a chenille machine, wherein the plurality of yarns comprises at least two core yarns and an effect yarn, and wherein at least one of the core yarns comprises a spun core yarn containing low-melting, staple-length binder fibers and high-melting, staple-length fibers;

entangling the at least two core yarns and the effect yarn in the chenille machine; and cutting the effect yarn to form a chenille yarn having portions of the effect yarn extending radially from the at least two core yarns of the chenille yarn.

2. The method of claim 1, wherein the low-melting, staple-length binder fibers have a melting point of less than about 110° C., and the high-melting, staple-length fibers have a melting point of greater than about 120° C.

3. The method of claim 2, wherein the low-melting, staple-length binder fibers comprise polyethylene, ethylene-propylene copolymers, or a combination thereof.

4. The method of claim 2, wherein the high-melting, staple-length fibers comprise polyester, nylon, acrylics, or a combination thereof.

5. The method of claim 1, further comprising the steps of:

carding a combination of low-melting, staple-length binder fibers and high-melting, staple-length fibers; and spinning the combination of low-melting, staple-length binder fibers and high-melting, staple-length fibers to form the spun core yarn.

6. The method of claim 1, further comprising the steps of:

unidirectionally feeding the chenille yarn into a heating chamber in a direction parallel to a length of the heating chamber, wherein the chenille yarn is not on a cone while traveling through the heating chamber; and heating the chenille yarn above a temperature at which the low-melting, staple-length binder fibers melt.

7. The method of claim 1, wherein the plurality of yarns consists of two core yarns and an effect yarn, and wherein each of the two core yarns comprises a spun core yarn containing low-melting, staple-length binder fibers and high-melting, staple-length fibers.

8. The method of claim 7, wherein each of the core yarns comprises about 20 wt % low-melting, staple-length polyethylene binder fibers and about 80 wt % acrylic staple-length fibers, based on a total weight of each core yarn; and the effect yarn comprises acrylic fibers.

9. The method of claim 1, further comprising the step of heating the chenille yarn above a temperature at which the low-melting, staple-length binder fibers melt.

10. A high performance chenille yarn comprising at least two core yarns and portions of at least one effect yarn extending radially from the at least two core yarns of the chenille yarn, wherein at least one core yarn comprises a spun core yarn containing low-melting, staple-length binder fibers and high-melting, staple-length fibers.

11. The chenille yarn of claim 10, wherein the chenille yarn is made by a method comprising:

feeding a plurality of yarns into a chenille machine, wherein the plurality of yarns comprises at least two core yarns and an effect yarn, and wherein at least one of the core yarns comprises a spun core yarn containing low-melting, staple-length binder fibers and high-melting, staple-length fibers;

entangling the at least two core yarns and the effect yarn in the chenille machine; and cutting the effect yarn to form a chenille yarn having portions of the effect yarn extending radially from the at least two core yarns of the chenille yarn.

12. The chenille yarn of claim 11, wherein the method of making the chenille yarn further comprises the step of heating the chenille yarn above a temperature at which the low-melting, staple-length binder fibers melt.

13. The chenille yarn of claim 10, wherein the low-melting, staple-length binder fibers comprise polyethylene, ethylene-propylene copolymers, or a combination thereof.

14. The chenille yarn of claim 10, wherein the high-melting, staple-length fibers comprise polyester, nylon, acrylics, or a combination thereof.

15. The chenille yarn of claim 10, wherein the effect yarn comprises cotton, wool, acrylic yarns, or a combination thereof.

16. The chenille yarn of claim 10, wherein the low-melting, staple-length binder fibers have an average fiber length of from about 0.5 to about 2 inches.

17. The chenille yarn of claim 10, wherein the chenille yarn consists of two core yarns and portions of at least one effect yarn extending radially from the two core yarns, and wherein each of the two core yarns comprises a spun core yarn containing low-melting, staple-length binder fibers and high-melting, staple-length fibers.

18. The chenille yarn of claim 17, wherein each of the core yarns comprises about 20 wt % low-melting, staple-length polyethylene binder fibers and about 80 wt % acrylic staple-length fibers, based on a total weight of each core yarn; and the portion of the effect yarn comprising acrylic fibers.

19. A method of making a chenille yarn comprising the steps of:

feeding two core yarns and an effect yarn into a chenille machine, wherein each of the core yarns comprises a spun core yarn containing low-melting, staple-length binder fibers;

entangling the two core yarns and the effect yarn in the chenille machine; and cutting the effect yarn to form a chenille yarn having portions of the effect yarn extending radially from the two core yarns of the chenille yarn.

20. The method of claim 19, wherein each of the spun core yarns further comprises high-melting, staple-length fibers.

21. The method of claim 20, wherein the low-melting, staple-length binder fibers have a melting point of less than about 110° C., and the high-melting, staple-length fibers have a melting point of greater than about 120° C.

22. The method of claim 20, wherein the high-melting, staple-length fibers comprise polyester, nylon, acrylics, or a combination thereof.

23. The method of claim 19, wherein the low-melting, staple-length binder fibers comprise polyethylene, ethylene-propylene copolymers, or a combination thereof.

24. The method of claim 19, further comprising the steps of:

unidirectionally feeding the chenille yarn into a heating chamber in a direction parallel to a length of the heating chamber, wherein the chenille yarn is not on a cone while traveling through the heating chamber; and heating the chenille yarn above a temperature at which the low-melting, staple-length binder fibers melt.

25. A high performance chenille yarn consisting of two core yarns and portions of at least one effect yarn extending radially from the two core yarns, wherein each of the two core yarns comprise a spun core yarn containing low-melting, staple-length binder fibers.

26. The chenille yarn of claim 25, wherein each of the two spun core yarns contain high-melting, staple-length binder fibers.

* * * * *